US006886368B2

(12) United States Patent
Matsuda

(10) Patent No.: US 6,886,368 B2
(45) Date of Patent: May 3, 2005

(54) WARP KNITTED TAPE FOR SLIDE FASTENER

(75) Inventor: Yoshio Matsuda, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/782,886

(22) Filed: Feb. 23, 2004

(65) Prior Publication Data

US 2004/0231368 A1 Nov. 25, 2004

(30) Foreign Application Priority Data

Feb. 24, 2003 (JP) ..... 2003-046241

(51) Int. Cl.[7] ..... D04B 21/14
(52) U.S. Cl. ..... 66/192; 66/195
(58) Field of Search ..... 66/193, 190, 192, 66/195, 170, 169 R, 202; 24/391, 392, 393, 398

(56) References Cited

U.S. PATENT DOCUMENTS

| | | | | |
|---|---|---|---|---|
| 3,974,550 A | | 8/1976 | Fujisaki et al. | |
| 4,002,045 A | | 1/1977 | Frohlich et al. | |
| 4,015,450 A | | 4/1977 | Matsuda et al. | |
| 5,257,515 A | | 11/1993 | Ikeguchi | |
| 6,006,552 A | * | 12/1999 | Matsuda et al. | 66/193 |
| 6,148,643 A | * | 11/2000 | Matsuda et al. | 66/193 |

FOREIGN PATENT DOCUMENTS

| | | |
|---|---|---|
| EP | 0 925 736 A2 | 6/1999 |
| EP | 1 048 238 A2 | 11/2000 |
| EP | 1 264 557 A1 | 12/2002 |
| JP | 51-44405 | 4/1976 |
| JP | 54-35769 | 10/1979 |
| JP | 55-37241 | 3/1980 |
| JP | 5-91908 | 4/1993 |

* cited by examiner

*Primary Examiner*—Danny Worrell
(74) *Attorney, Agent, or Firm*—Finnegan, Henderson, Farabow, Garrett & Dunner, L.L.P.

(57) ABSTRACT

Among knitting yarns forming stitches of a fastener element attaching portion of a warp knitted tape for a slide fastener composed of multiple wales, a dry heat shrinkage ratio of one or more knitting yarns disposed across adjoining wales such that they at least entangle with another knitting yarn on the wales in the fastener element attaching portion is set lower than a dry heat shrinkage ratio of other knitting yarns composing the warp knitted tape. Preferably, a multifilament yarn composed of fine filament fibers of 0.5 to 4 dTex is used for all the knitting yarns. With such a structure, fastener elements can be sewed accurately, so that a soft warp knitted tape having no hardness due to thermal setting and an excellent drape performance can be obtained, this knitted tape allowing a smooth opening/closing operation of a slider after the fastener elements are mounted.

6 Claims, 6 Drawing Sheets

WARP KNITTED TAPE FOR SLIDE FASTENER

BACKGROUND OF THE INVENTION

1. Field of the Invention

This invention relates to a warp knitted tape for a slide fastener and more particularly to a warp knitted tape for a slide fastener that enables elements to be sewed to a fastener tape easily and accurately and has excellent flexibility and texture.

2. Description of the Related Art

Recently, the slide fastener has been often employed in various kinds of clothes, particularly, clothes ample in flexibility or drape performance or thin clothes. In such a clothes field, naturally, the slide fastener is demanded to have ample flexibility and drape performance or be thin-structured. However, the slide fastener is demanded to have stability in its structure as well as to satisfy such a demand. A knitted fabric is most suitable for the fastener tape having ample flexibility and drape performance or thin-structured from viewpoints of its structure and to secure the stability in structure at the same time, a warp knitting structure capable of controlling stretchability is optimum.

Conventionally, the slide fastener tape having such a warp knitting structure has been well known through, for example, Japanese Utility Model Application Laid-Open No. 51-44405, Japanese Utility Model Application Publication No. 54-35769, Japanese Patent Application Publication No. 55-37241 and Japanese Patent Application Laid-Open No. 5-91908. The warp knitted tapes for the slide fastener disclosed in these publications have specific purposes respectively and their warp knitting structure and yarn handling are devised in various ways to achieve each purpose.

For example, according to the aforementioned Japanese Utility Model Application Laid-Open No. 51-44405, because in the conventional warp knitted tape for the slide fastener, wales formed on the tape have the same hardness, when the tape is sewed to a cloth or the like, the same wale restricts or blocks a smooth piercing of a sewing needle. To solve this problem, a number of constituent knitting yarns in a wale adjacent to a needle piercing portion is reduced to be smaller than that of the constituent yarns in other wales, thereby adaptability of the wale adjacent to the needle piercing portion to the piercing of the sewing needle being heightened. According to the Japanese Utility Model Application Publication No. 54-35769, a wale adjacent to a wale in the most side edge portion of the fastener tape is formed more bulky than the wale in the side edge, and wale grooves disposed on both sides of this bulky wale are formed wider than the wales in the other knitted portion. At the same time, the other knitted portion is constructed with uniform warp knitting structure and the bulky wale is engaged with a concave groove formed in a leg portion of the fastener elements so as to prevent the elements from deflecting therefrom. According to the Japanese Patent Application Publication No. 55-37241, wales are formed with the knitting structure composed of chain knitting and two-needle stitch by use of a non-textured yarn, and two kinds of textured yarns each having a different contraction are knitted in as a weft in-laid yarn in order to obtain a warp knitted tape which does not stretch much and has a excellent texture.

According to the Japanese Patent Application Laid-Open No. 5-91908, the non-textured yarn is used for all knitting yarns in the fastener element attaching portion, the non-textured yarn is used for the chain knitting yarn in the tape main portion and the textured yarn is used for a tricot knitting yarn and weft in-laid yarn so as to achieve different tape thickness in the element attaching portion and tape main body. At the same time, two wales located at its border are formed in the same size and a wale groove composed mixedly of the textured yarns and the non-textured yarns is formed between those wales. Consequently, it is intended to obtain a warp knitted tape which allows an accurate inversion at a specific position when a hidden type slide fastener is finished and which enables its sewing position to be identified easily when it is sewed to clothes.

For the conventional slide fastener having the warp knitting structure, usually, multiple fastener tapes connected with each other by a connecting yarns are knitted at the same time with a large-sized knitting machine and after the knitting is completed, the connecting yarns are cut out. Fastener elements are attached along a side edge of the independent fastener tape manufactured in this way by sewing. However, to cope with manufacturing of multiple kinds with each small production amount in recent years, there is no way but knitting a single tape or a pair or right and left tapes at most with a small knitting machine.

Then, a problem specific for a fastener tape manufactured with the small knitting machine occurs. Usually, the warp knitting structure of the fastener tape knitted in this way is composed of multiple knitting structures, for example, chain knitting, tricot knitting, satin knitting, weft in-laid knitting and the like. If a single body of the fastener tape is knitted with such a knitting structure, both side edges (ear portions) of the same tape are squeezed strongly by the weft knitting yarns, so that a groove between wales in the fastener attaching portion on the side edge is distinguished. Even if it is intended to attach the fastener elements to the fastener tape, as the wale groove forming its sewing line is not evident, the sewing position is deviated and sufficient element attachment strength is not obtained.

To improve productivity, a knitted fastener tape needs to be set thermally on the sewing machine. This thermal setting is carried out under a tension and due to contraction and hardening by heat, its soft texture is lost and a finished product becomes hard. Thus, this fastener tape is not suitable for soft fabric of women's or children's clothes and the like and further, when this fastener tape is sewed to fabric, warpage or stretching occurs, which should be solved. As a result, after a product is completed, sliding resistance of a slider to the fastener elements increases and particularly, there occurs an extreme difference in the sliding resistance at the time of opening/closing the fastener, thereby losing smoothness in the opening/closing operation by the slider.

Therefore, an object of the invention is to provide a warp knitted tape for a slide fastener to be manufactured by a single unit, and more particularly to a warp knitted tape for a slide fastener, having an excellent follow-up performance to object clothes when this fastener tape is sewed thereto, the warp knitted tape allowing an accurate sewing of fastener elements, being soft despite thermal setting and ample in drape performance and allowing a smooth opening/closing by the slider when the fastener elements are attached.

SUMMARY OF THE INVENTION

The above-described object is achieved effectively by a warp knitted tape for a slide fastener, having narrow width and multiple wales extended in parallel in a length direction, being characterized in that, among knitting yarns forming stitches of the fastener element attaching portion composed of multiple wales, a dry heat shrinkage ratio of knitting yarns disposed across at least one of the wales in a course direction such that they at least entangle with another knitting yarn on the wales in the fastener element attaching portion is set lower than a dry heat shrinkage ratio of knitting yarns composing the warp knitted tape.

The warp knitted tape for a slide fastener has an element attaching portion on a side edge in a tape width direction like an ordinary woven tape while the other portion acts as a tape main body. However, as described above, knitting structures of the element attaching portion and the tape main body are not different unless there is any special reason. Ordinarily, the wales are formed by using either a chain knitting yarn or a tricot knitting yarn or both of them and respective wales are connected by a weft in-laid knitting yarn. In some case, a two needle stitch knitting yarn or a satin knitting yarn which connect the wales at the same time when the wales are formed is used instead of these knitting yarns.

According to the invention, the dry heat shrinkage ratios of the tricot knitting yarn and satin knitting yarn which form stitches on the wales and run obliquely in a weft direction across a course, which are among the knitting yarns disposed in the element attaching portion to compose the wales, and other knitting yarns used as the weft in-laid knitting yarns which run in zigzag fashion between adjacent courses while going and returning between multiple wales are set lower than the dry heat shrinkage ratios of other knitting yarns composing the warp knitted tape.

Due to such a structure, for example, when dry heat setting is applied to the knitted tape, the tape main body is contracted largely in the tape width direction such that a interval between the wales narrows. However, in the element attaching portion, the interval between the wales is hardly squeezed by the knitting yarns because the dry heat shrinkage ratio of the knitting yarn which entangle with the stitch of the wale while running in the weft direction is low. As a result, the interval between the wales does not narrow so much. Consequently, when fastener elements are attached by sewing to the element attaching portion in a manufactured warp knitted tape for a fastener, the sewing yarn becomes easy to be accurately sewed in at a sewing position of the fastener elements. Thus, after the slide fastener is finished, the elements of right and left stringers are coupled with each other securely so as to secure its coupling strength. Further, because right and left element rows form accurate lines, sliding resistance of the slider is small, thereby achieving smooth opening/closing operation.

Moreover, preferably, the dry heat shrinkage ratio of the knitting yarns disposed across one or more adjoining wales such that they entangle on the wales in the fastener element attaching portion is 4 to 10% while the dry heat shrinkage ratio of the other knitting yarns which compose the stitch in the tape main body is 10 to 20%. Here, the dry heat shrinkage ration of the knitting yarn of 10 to 20% indicates a shrinkage ratio of a case where the knitting yarn is utilized ordinarily and it can be understood easily how low it is that the dry heat shrinkage ratio of the knitting yarn disposed across the adjoining wales while entangling with the wales in the fastener element attaching portion is 4 to 10%. If the dry heat shrinkage ratio is smaller than 4%, contraction of the weft in-laid knitting yarn and satin knitting yarn disposed in the element attaching portion is too small, so that width of a groove between the wales is likely to be enlarged. Consequently, the position of the sewing yarn in the elements to the fastener tape is likely to be deviated and the fastener elements are likely to be moved on a tape after a product is completed thereby possibly generating missing elements. If the dry heat shrinkage ratio exceeds 10%, the contraction is so large that the width of the groove between the wales becomes too small and consequently, the sewing needles cannot be pierced accurately into the groove.

Preferably, the dry heat shrinkage ratio of knitting yarns disposed across one or more wales such that they entangle with a wale most adjacent to the fastener element attaching portion is 4 to 10%.

Preferably, width of a groove between the wale in the tape main body most adjacent to the element attaching portion and a wale in the tape main body adjacent to the same wale is 0.8 to 1.5 mm, although it differs depending on a size of a sewing needle. With such a structure, the sewing position of a sewing thread becomes constant. Especially, in case where this fastener tape is utilized for a hidden type slide fastener, the wales in the tape main body most adjacent to the element attaching portion becomes hard to move even when a strong force is applied in a direction of separating coupling elements, so that a contact between the wales is maintained. Further, if the width of the groove between multiple wales formed in the element attaching portion is 0.8 to 1.5 mm, sewing of the element is achieved accurately and securely, and consequently, moving of the element within a loop of the sewing yarns is eliminated.

For control of this groove width, controlling the dry heat shrinkage ratio of the knitting yarn running across the wales such as the weft in-laid knitting yarn or satin knitting yarn in the element attaching portion is most effective. However, the width of the groove between the wales in the element attaching portion can be controlled without depending on the heat shrinkage ratio, for example, by selecting a size of the chain knitting yarn or tricot knitting yarn which forms the wale in the element attaching portion, or alternatively by adding the warp in-laid knitting yarn running in a zigzag fashion on the same wale so as to increase sectional area of the wale.

According to the invention, preferably, the knitting yarns composing the wales in the fastener element attaching portion except the knitting yarns disposed across two or more adjoining wales such that they entangle the wales in the fastener element attaching portion are formed of multifilament yarns each composed of multiple filaments having a single fiber size of 0.5 to 1.5 dTex. Additionally, the knitting yarns disposed across adjoining wales such that they entangle with the wales in the fastener element attaching portion are preferably formed of multifilament yarns each composed of multiple filaments having a single fiber size of 1.5 to 4.0 dTex.

For example, in this kind of the warp knitted tape, the multifilament yarns composed of multiple filaments are used in some cases and the size of the same multifilament yarn is usually, 110-dTex multifilament yarn composed of 24 filaments or 330-dTex multifilament yarn composed of 36 filaments. The size of each filament unit is quite large, that is, 4 to 9 dTex.

Contrary to this, it is understood that the multifilament yarn composed of multiple much finer filaments than conventional filaments is used for all knitting yarns which form the fastener tape of the invention. Additionally, the single fiber size of each filament composing all the knitting yarns except the weft in-laid knitting yarns and warp in-laid knitting yarns disposed across one or more adjoining wales such that they entangle with the wales in the fastener tape is set to as low as 0.5 to 1.5 dTex. The single fiber size of each constituent filament of the weft in-laid knitting yarn and warp in-laid knitting yarn composed of multiple filaments is set to 1.5 to 4.0 dTex, which is larger than the size of the constituent filament of the aforementioned knitting yarns.

Thus, according to the invention, the filament having a smaller size than the conventional filament is utilized and particularly, the size of the constituent filament of the knitting yarns composing mainly the wale of the fastener tape is set to smaller than the constituent filament of other weft in-laid knitting yarns and warp in-laid knitting yarns. If a multifilament yarn composed of multiple filaments having a smaller size than conventional is utilized, the flexibility of the single filament itself is increased. Further, because respective filaments are likely to be separated after the multifilament yarn is formed, the flexibility of the entire yarn depends upon the flexibility of the constituent filament, so that the flexibility of the knitting yarn is extremely intensified. As a result, the flexibility of the fastener tape, particularly the flexibility in the length direction of the tape is improved and the stability in configuration in the width direction of the tape is secured. Furthermore, the drape performance of the entire tape is increased. A product after the slide fastener using the warp knitted tape of the invention is sewed to soft fabric is finished beautifully without any warpage or stretching in its sewed portion.

In addition to that the flexibility in the length direction of the fastener tape is excellent, the stability in configuration in the tape width direction is secured, the flexibility of the entire slide fastener is secured at the same time and its drape performance is excellent, elements are mounted accurately and securely at a predetermined position of the warp knitted tape. Moreover, when the warp knitted tape of the invention is sewed to soft fabric, not only it fits the softness of the fabric well but also beautiful sewing is achieved and smooth opening/closing operation of the slider is also achieved.

Further, according to the invention, preferably, all the knitting yarns which form the tape main body are composed of bulky processed yarns. If the bulky processing yarn is utilized for the tape main body, hardness in the entire slide fastener is eliminated, so that the obtained slide fastener becomes extremely soft. The use of the bulky processed yarns is not restricted to the tape main body, but may be applied to the element attaching portion if required.

DESCRIPTION OF THE PREFERRED EMBODIMENTS

Figure 1:
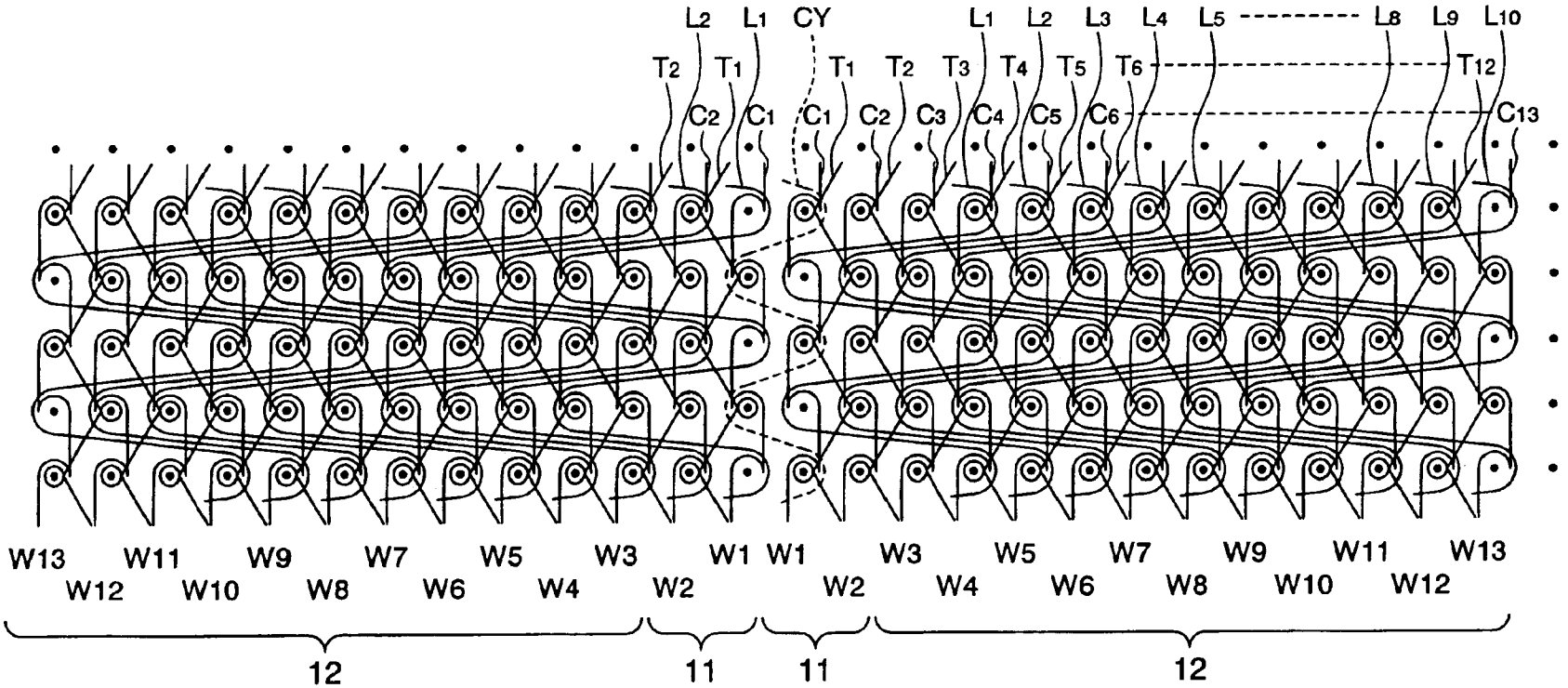
FIG. 1 is a knitting structure diagram of an entire warp knitted tape for a hidden type slide fastener according to a first embodiment of the invention.
Figure 2:
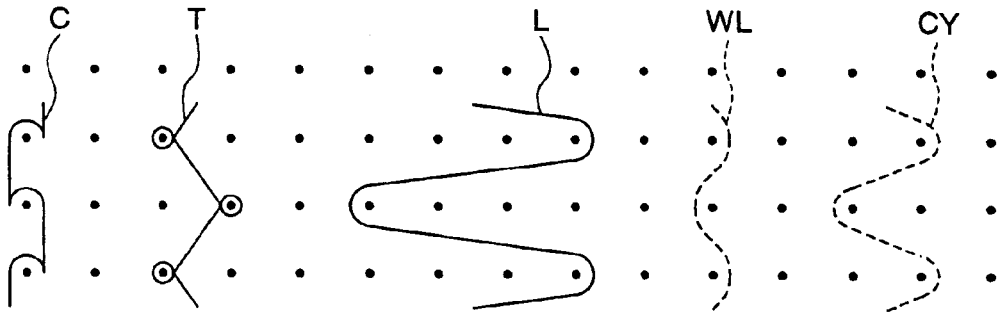
FIG. 2 is a knitting structure diagram of each constituent knitting yarn of the same warp knitted tape.
Figure 3:
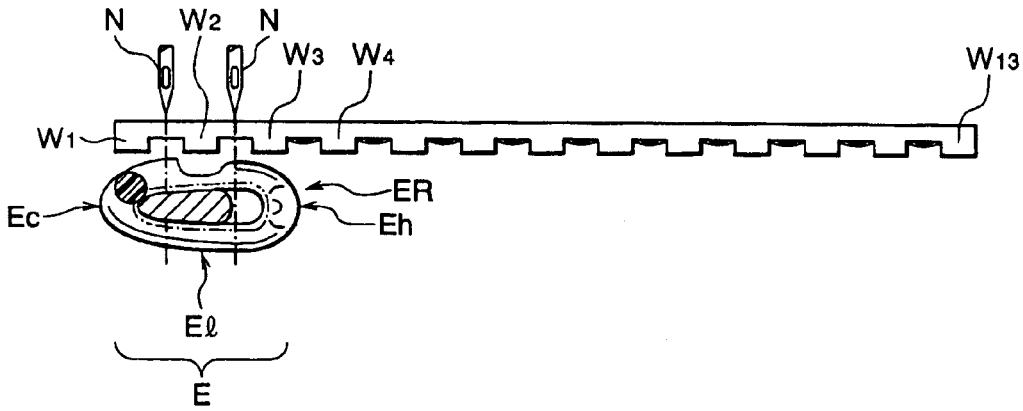
FIG. 3 is an explanatory diagram showing a sewing condition of the fastener elements to the warp knitted tape.
Figure 4:
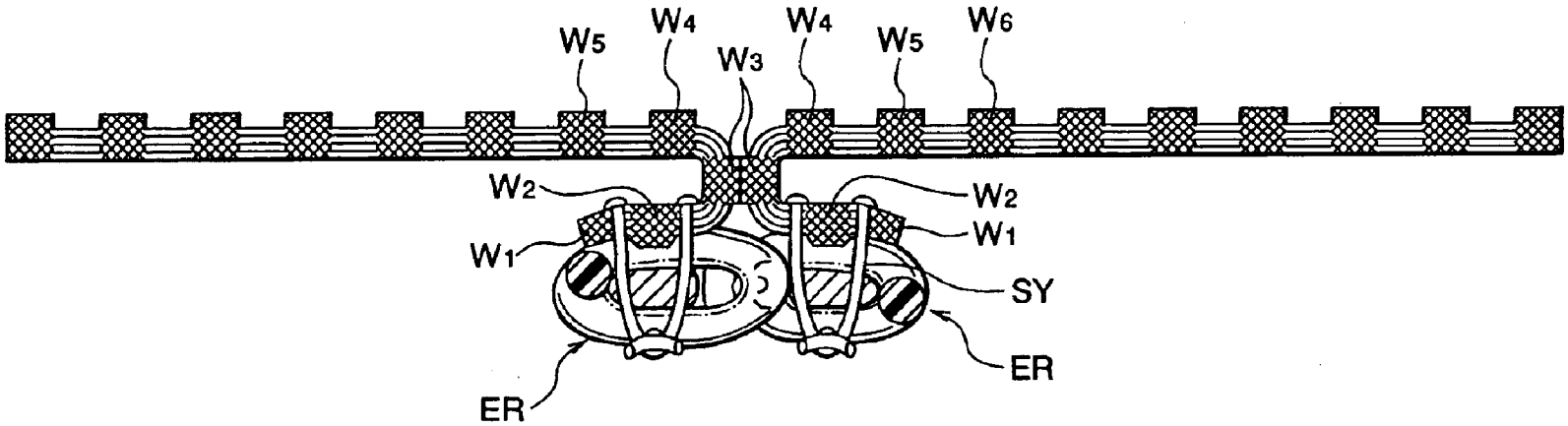
FIG. 4 is a front view schematically showing the structure of the hidden type slide fastener utilizing the warp knitted tape.

Hereinafter, typical embodiments of a warp knitted tape for a slide fastener of this invention will be described in detail with reference to accompanying drawings. FIGS. 1 to 4 show a warp knitted tape for a hidden type slide fastener according to a first embodiment of the invention, FIG. 2 is a warp knitting structure of each constituent knitting yarn, FIG. 3 is a schematic diagram of a case where fastener elements are mounted on the warp knitted tape of this embodiment and FIG. 4 is a front view schematically showing a hidden type slide fastener finished with the same tape.

As for a warp knitted tape 10 for a hidden type slide fastener of this embodiment, a pair of warp knitted tapes for the right and left are knitted at the same time by a single knitting machine. The entire width of each of the warp knitted tapes 10 is composed of 13 wales $W_1$ to $W_{13}$. Two wales $W_1$, $W_2$ disposed on opposing side edge portions serve as a fastener element attaching portion 11. Remaining wales $W_3$ to $W_{13}$ disposed inside of the same element attaching portion 11 form a tape main body 12. This warp knitted tape 10 is comprised of chain knitting yarns $C_1$ to $C_{13}$ of 1-0/0-1 disposed in each of the wale $W_1$ to $W_{13}$, tricot knitting yarns $T_1$ to $T_{12}$ of 1-2/1-0 which connects adjacent wales with a sinker loop and forms a needle loop on adjacent wales, and weft in-laid knitting yarns $L_1$ to $L_{10}$ of 0-0/4-4 running in a zigzag fashion across four wales.

The pair of warp knitted tapes 10, 10 for the right and left sides are connected by a connecting knitting yarn CY of 0-0/2-2 which connects the first wales $W_1$, $W_1$ of the opposing fastener element attaching portions 11 in the zigzag fashion. Although not represented in FIG. 1 to facilitate understanding thereof, warp in-laid knitting yarns $WL_1$, $WL_2$ having a knitting structure of 0-0/1-1 are knitted in the first and second wales $W_1$, $W_2$ formed in the fastener element attaching portion 11 as well as the chain knitting yarns $C_1$, $C_2$, the tricot knitting yarns $T_1$, $T_2$ and the weft in-laid knitting yarns $L_1$, $L_2$ such that they run in the zigzag fashion along the respective wales $W_1$, $W_2$.

The most prominent feature of this embodiment is that the physical property and structure of part of the knitting yarns used for the fastener element attaching portion 11 and the tape main body 12 are changed. Yarns having a dry heat shrinkage ratio of 4 to 10% are used for the tricot knitting yarns $T_1$ to $T_3$ and the weft in-laid knitting yarns $L_1$ to $L_3$entangling with three wales $W_1$ to $W_3$ formed in the fastener element attaching portion 11 and the tape main body 12 adjacent to the same attaching portion 11. And yarns having a high dry heat shrinkage ratio of 10 to 20% are used for all the chain knitting yarns $C_1$ to $C_{13}$, the warp in-laid knitting yarns $WL_1$, $WL_2$ disposed in the wales $W_1$, $W_2$ in the fastener element attaching portion 11, the tricot knitting yarns $T_4$ to $T_{12}$ disposed in the remaining wales $W_4$ to $W_{13}$ in the tape main body 12 and the weft in-laid knitting yarns $L_4$ to $L_{10}$.

Yarns having a low dry heat shrinkage ratio are used for the tricot knitting yarns $T_1$ to $T_3$ disposed in the zigzag fashion such that they are entangled with the two wales $W_1$, $W_2$ in the fastener element attaching portion 11 and the wale $W_3$ adjacent to the same wales $W_1$, $W_2$ and returned and the weft in-laid knitting yarns $L_1$ to $L_3$ having a knitting structure of 0-0/4-4. And yarns having a high dry heat shrinkage ratio are used for the knitting yarns composing all the wales in the tape main body 12 except the wale $W_3$ adjacent to the fastener element attaching portion 11. Consequently, after thermal setting, the contraction of the weft in-laid knitting yarns $L_1$ to $L_3$ disposed in the fastener element attaching portion 11 and in the vicinity thereof is small and the change of width in the tape width direction of the four wales $W_3$ to $W_6$ as well as the two wales $W_1$, $W_2$ in the fastener element attaching portion 11 is smaller than that of the other wales $W_7$ to $W_{13}$ in the tape main body 12. Contrary to this, the tape main body 12 is contracted largely in the tape width direction so as to narrow intervals between the wales. As a result, when fastener elements are attached to the element attaching portion 11 of the manufactured fastener warp knitted tape 10 by sewing, the sewing yarn becomes easy to be sewed accurately at a sewing position in the fastener element. Thus, after the slide fastener is finished, elements E on the right and left stringers are coupled with each other securely, so that a sufficient coupling strength is secured and further, right and left element rows ER are arranged highly neatly. Consequently, the sliding resistance of the slider is small thereby achieving a smooth opening/closing operation.

According to the invention, the fact that multifilament yarns composed of multiple filament fibers being utilized for all knitting yarns which compose the warp knitted tape 10 while those filament fibers having very small sizes can be another feature. Because a multifilament yarn which is an assembly of filament fibers having small size is composed of fine and flexible filament fibers while each filament fiber can move freely to some extent, the multifilament yarn itself has an extreme flexibility, so that a warp knitted tape to be obtained is very soft and has an excellent drape performance.

The size of each of the filament fibers composing the multifilament yarn used for the invention is very small, that is, 0.5 to 4.0 dTex. How small this value is can be understood easily from a fact that the size of each of the filament fibers of the multifilament yarn used for an ordinary warp knitted tape is 4 to 9 dTex. According to this embodiment, in the above-described fiber size range, a fine filament fiber whose single fiber size is 0.5 to 1.5 dTex is used for all the chain knitting yarns $C_1$ to $C_{13}$ and tricot knitting yarns $T_1$ to $T_{12}$ and a filament fiber having a relatively large single fiber size, whose single fiber size is 1.5 to 4 dTex, is used for the weft in-laid knitting yarns $L_1$ to $L_{10}$ and the warp in-laid knitting yarns $WL_1$, $WL_2$. Although according to this embodiment, the fine filament fiber whose single fiber size is 0.5 to 1.5 dTex is used for all the chain knitting yarns $C_1$ to $C_{13}$ and tricot knitting yarns $T_1$ to $T_{12}$ in the warp knitted tape 10, the size of the filament fiber used as the multi-filament yarn which forms wales in the tape main body 12 is not restricted to the above-mentioned size, but if some extent of rigidity is allowed as the warp knitted tape, a filament fiber having a larger size can be used.

As described above, the very fine filament fiber is used for the chain knitting yarns $C_1$ to $C_{13}$ and tricot knitting yarns $T_1$ to $T_{12}$ which are knitting yarns mainly forming all the wales in the warp knitted tape while the filament fiber having a relatively large single fiber size is used for the weft in-laid knitting yarns $L_1$ to $L_{10}$, the configuration of the tape in its width direction is stabilized while a sufficient flexibility of the fastener element attaching portion 11 is secured. Meanwhile the reason why the filament fiber having a relatively large single fiber size is also used for the warp in-laid knitting yarns $WL_1$, $WL_2$ which entangle along the wales $W_1$, $W_2$ in the fastener element attaching portion 11 is to stabilize the configuration of the fastener element attaching portion 11. The reason why the filament fiber having a large single fiber size is used for the warp in-laid knitting yarns $WL_1$, $WL_2$ disposed in the two wales $W_1$, $W_2$ in the tape main body 12 is to intend to secure some extent of rigidity in the tape length direction in the fastener element attaching portion 11.

According to this embodiment, bulky processed yarns are used for all knitting yarns which, compose at least the tape main body 12. If the bulky processed yarns are used for all the knitting yarns in the tape main body 12, a soft feeling of the tape main body 12 is improved, and for example, even if the tape is utilized in a portion requiring delicate texture such as underwear, there is no feeling of disharmony. In the meantime, the bulky processed yarn may be used as a constituent yarn in the fastener element attaching portion 11. If the bulky processed yarn is utilized in the fastener element attaching portion 11, not only the soft feeling but also drape performance are improved in the entire hidden type slide fastener CF as a finished product.

According to this embodiment, a multifilament yarn of 78 dTex in its total size composed of 72 filament fibers whose single fiber size is 1.08 dTex is used for the chain knitting yarns $C_1$ to $C_{13}$. A multifilament yarn of 110 dTex in total size composed of 96 filament fibers whose single fiber is 1.14 dTex is used for the tricot knitting yarns $T_1$ to $T_{12}$ and a multifilament yarn of 110 dTex in total size composed of 48 filament fibers whose single fiber size is 2.29 dTex is used for the weft in-laid knitting yarns $L_1$ to $L_{10}$. Further, a multifilament fiber of 167 dTex in total size composed of 60 filament fibers whose single fiber size is 2.78 dTex is used for the warp in-laid knitting yarns $WL_1$, $WL_2$.

Because this embodiment concerns the warp knitted tape for the hidden type slide fastener, the total size of the multifilament fiber to be used for the chain knitting yarn $C_3$ disposed in the wale $W_3$ in the tape main body 12 adjacent to the fastener element attaching portion 11 can be increased further. In this case, when the warp knitted tape 10 provided with the elements E is folded back through an inverted portion adjacent to the fastener element attaching portion 11, the wale $W_3$ is expanded. As a result, it makes a strong contact with a mating wale $W_3$ when the elements are coupled. Consequently, even if a strong laterally pulling force is applied to the slide fastener in the tape width direction, the wales $W_3$ are unlikely to be separated, so that the element row ER located inside is not visible from outside (see FIG. 4).

In the warp knitted tape for the hidden type slide fastener of this embodiment manufactured in the above-described way, groove width is secured clearly between the two wales $W_1$, $W_2$ in the fastener element attaching portion 11 and the wale $W_3$ adjacent to the same attaching portion 11 as described above, a sewing yarn SY can be sewed at a predetermined position of the element E as shown in FIG. 3 when the fastener elements E are attached to the warp knitted tape 10 by sewing. After a product is completed, the elements do not move on the tape and no missing elements E or decoupling occurs. The obtained warp knitted tape 10 is entirely flexible, ample in drape performance and very soft, so that it can be sewed beautifully to a flexible fabric with an excellent follow-up performance.

When the hidden type slide fastener CF as shown in FIG. 4 is manufactured with the warp knitted tape 10, a continuous fastener element row ER formed into a coil using a thick monofilament of synthetic resin is disposed on a wale face formed on the fastener element attaching portion 11 of the warp knitted tape 10 such that its coupling head Eh of each element E is directed to the tape main body 12 while its connecting portion Ec is disposed on a tape side edge. A sewing needle N is pierced through two grooves formed between respective wales, that is, one between the two wales $W_1$ and $W_2$ in the fastener element attaching portion 11 and the one between the wale $W_2$ and the wale $W_3$ in the tape main body 12 adjacent to the wale $W_2$, so as to sew the tape. At this time, if the groove width between the respective wales is out of a range of 0.8 to 1.5 mm, the sewing needle N cannot be pierced accurately because the groove width is too small, or even if it can be pierced, the element E cannot be fixed at a predetermined position because the groove width is too large, so that after the sewing, the sewing yarn may loosen. Consequently, the element E becomes likely to move in the tape width direction and it may slip out in some cases. Further, the respective elements E are likely to be arranged in disorder, so that the opening/closing operation of the slide fastener by a slider (not shown) is difficult to execute smoothly.

If the fastener element row ER is attached to the warp knitted tape 10 with the sewing yarn SY as mentioned above, the inverted portion between the fastener element attaching portion 11 and the tape main body 12 is folded and formed with the fastener element row ER outside. This folding is executed with the wale $W_3$ in the tape main body 12 adjacent to the wale $W_2$ inside of the fastener element attaching portion 11 as a vertex as shown in FIG. 4. After this folding is completed, the warp knitted tape is sewed to a sewing portion of an object fabric. The sewing portion at this time is a wale groove formed between the wale $W_3$ in the tape main body 12 adjacent to the wale $W_2$ inside of the fastener element attaching portion 11 and the wale $W_4$ adjacent to the wale $W_3$ in FIG. 3.

The groove width to be formed between the wale $W_3$ and the wale $W_4$ is preferred to be 0.8 to 1.5 mm like the fastener element attaching portion 11. With such a groove width, the sewing is carried out accurately and stably, and further the groove is never moved between loops in sewing yarns. Even if a lateral pulling force in a tape width direction of releasing the coupling of elements is applied to the coupled elements in the hidden type slide fastener CF, the wales $W_3$ in the tape main body 12 adjacent to the wales $W_2$ inside of the right and left fastener element attaching portions 11 keep their fitting condition thereby maintaining the function of the hidden type slide fastener CF.

If in the hidden type slide fastener CF manufactured in this way, opposing element rows ER of the right and left stringers S are coupled with each other, the wales $W_3$ located at the vertex of the folding portion are brought into a firm contact with each other as shown in FIG. 4, so that the fastener element row ER turns invisible from outside. Now, if an external force is applied to clothes on which this hidden type slide fastener CF is mounted and a strong lateral pulling force in a direction of separating the right and left stringers S is applied, the fastener element row ER can be visible. This is fatal problem for the hidden type slide fastener CF. Thus, in this embodiment, the wale $W_3$ may be formed largely by using a yarn having a larger size than the other knitting yarns as the chain knitting yarn $C_3$ to be disposed in the wale $W_3$ as described above.

Figure 5:
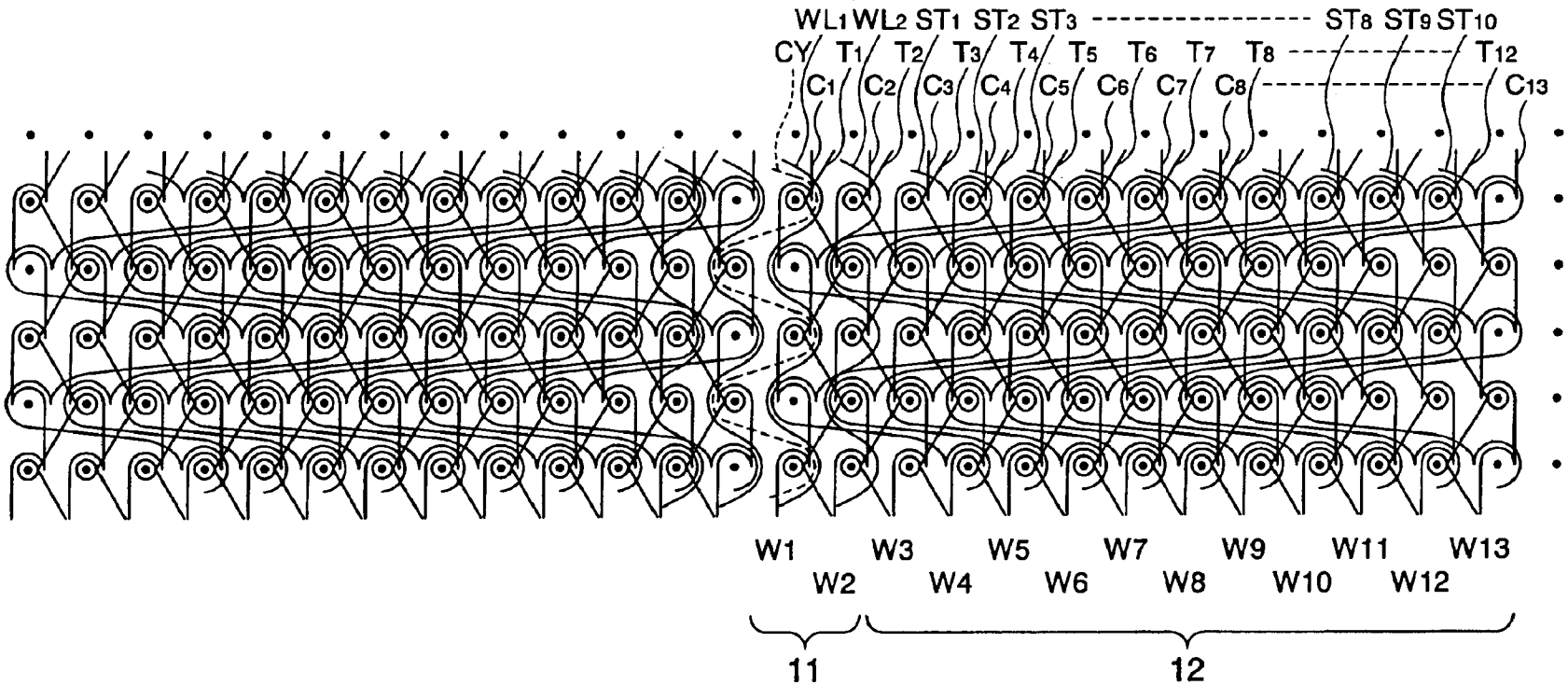
FIG. 5 is an entire knitting structure diagram of a warp knitted tape for an ordinary slide fastener according to a second embodiment of the invention.
Figure 6:
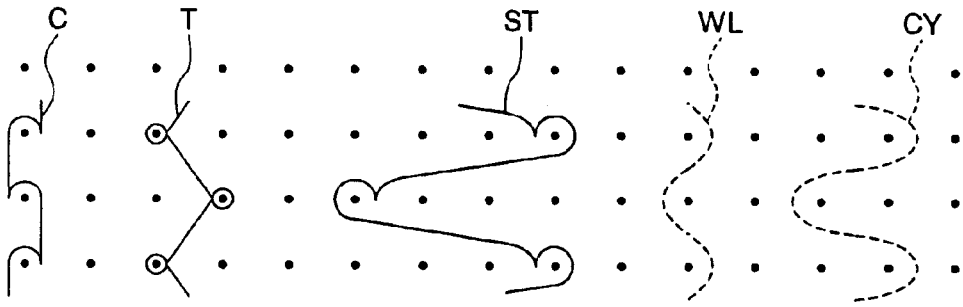
FIG. 6 is a knitting structure diagram of each constituent knitting yarn of the same warp knitted tape.
Figure 7:
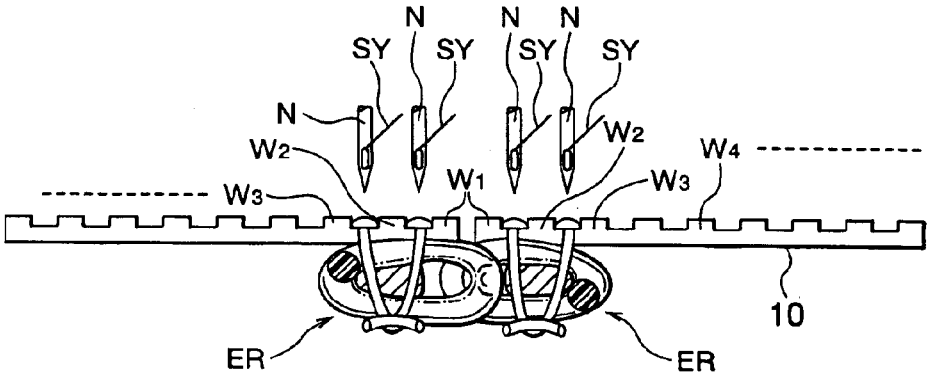
FIG. 7 is an explanatory diagram showing a first sewing condition of the fastener elements to the warp knitted tape.
Figure 8:
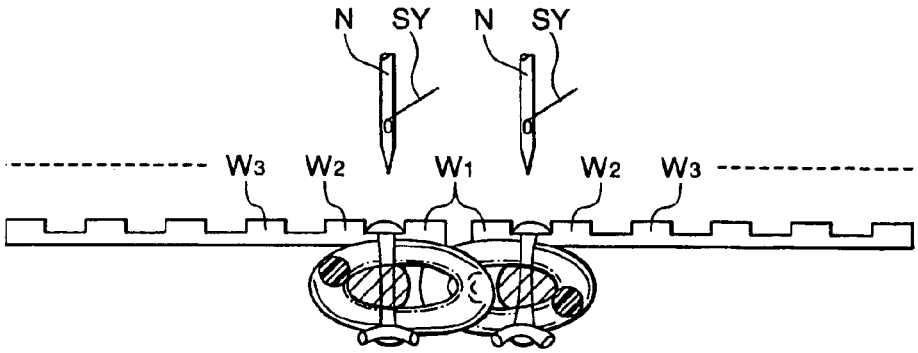
FIG. 8 is an explanatory diagram showing a second sewing condition of the fastener elements to the warp knitted tape.

FIGS. 5 to 8 show a second embodiment of the invention. FIG. 5 shows the knitting structure of an entire warp knitted tape for the slide fastener according to this embodiment and FIG. 6 shows the knitting structure of each knitting yarn of the same structure. FIG. 7 shows a first sewing condition of the fastener element to the same warp knitted tape and FIG. 8 shows a second sewing condition of the fastener element to the same warp knitted tape. The warp knitted tape 10 of this embodiment is a warp knitted tape for an ordinary slide fastener knitted by a single warp knitting machine.

In this embodiment, since the structure of the knitting yarn (multifilament yarn), the dry heat shrinkage ratio of the knitting yarn, the size of the knitting yarn and the single fiber size of a filament fiber composing each knitting yarn are the same as those in the first embodiment, a detailed description thereof is omitted and mainly a structure different from the first embodiment will be described specifically.

In this embodiment also, the basic knitting structure which forms the respective wales $W_1$ to $W_{13}$ in the warp knitted tape 10 is comprised of a chain knitting and a tricot knitting like the first embodiment. The warp in-laid knitting yarns $WL_1$, $WL_2$ having a knitting structure of 0-0/1-1 are knitted into the two wales $W_1$ $W_2$ disposed in the fastener element attaching portion 11. The structure different from the first embodiment is a knitting structure of knitting yarns running across one or more wales. According to this embodiment, satin knitting yarns $ST_1$ to $ST_{10}$ having a knitting structure of 0-1/4-3 are utilized instead of the weft in-laid knitting yarns $L_1$-$L_{10}$ of the first embodiment. By adopting this feature, needle loops are formed by all knitting yarns except the warp in-laid knitting yarns $WL_1$, $WL_2$ in all the wales $W_1$ to $W_{13}$ formed in the warp knitted tape 10 in addition to effects of the first embodiment. Consequently, the entire configuration of the warp knitted tape is stabilized.

According to the first sewing condition of attaching the fastener elements E to the warp knitted tape 10 by sewing, as shown in FIG. 7, a coil-like continuous fastener element row ER made of thick monofilaments of synthetic resin are sewed on wale surfaces formed in the fastener element attaching portion 11 of the warp knitted tape 10 by piercing a sewing needle N into each of two grooves formed between the two wales $W_1$, $W_2$ in the fastener element attaching portion 11 and between the wale $W_2$ and the wale $W_3$ adjacent to the wale $W_2$ in the tape main body 12 according to so-called 2-needle 1-looper method.

According to the second sewing condition of attaching the fastener element E to the warp knitted tape by sewing, as shown in FIG. 8, the continuous fastener element row ER made of the thick monofilaments of synthetic resin is sewed to the wale surface formed in the fastener element attaching portion 11 of the warp knitted tape 10 by piercing a sewing needle N into a single groove formed between the two wales $W_1$ and $W_2$ in the element attaching portion 11 according to the 1-needle 1-looper method.

Because the warp knitted tape 10 of the second embodiment is intended for an ordinary slide fastener, after the fastener element row ER is sewed as described previously, the warp knitted tape 10 is not folded unlike the first embodiment, and then, the ordinary slide fastener SF is completed through a slider mounting step, an upper/lower stopper devices attaching step and other various finishing steps (not shown).

The respective embodiments described above indicate the typical examples of the invention and the invention is not restricted to these embodiments, for example, the warp knitting structure mentioned in the invention is not restricted to combinations of chain knitting, tricot knitting, warp in-laid knitting, weft in-laid knitting and satin knitting, but other various knitting structures may be combined. Further, although as the yarn structure of the knitting yarn, a multifilament yarn having substantially no twisting is utilized for all knitting yarns in the above-described embodiments, a twist yarn may be used for part of knitting yarns such as the chain knitting yarn in the fastener element attaching portion, and further the total size of each knitting yarn is not restricted to the above-described embodiment but may be changed in various ways as required.

What is claimed is:

1. A warp knitted narrow width tape for a slide fastener comprising:

a plurality of wales extended in parallel along a length direction of the tape, wherein the wales are divided into a first group of the wales having at least two of the wales, the first group of wales being associated with a fastener element attaching portion of the tape disposed along a side edge of the tape and extending in a width direction, and a remaining group of the wales being associated with a tape main body adjacent to the fastener element attaching portion of the tape;

one or more first knitting yarns disposed across adjoining wales in the first group of wales;

a second knitting yarn on each of the wales in the first group of wales, the second knitting yarn and the one or more first knitting yarns being entangled; and one or more other knitting yarns composing the warp knitted tape associated with the tape main body;

wherein a dry heat shrinkage ratio of the one or more first knitting yarns and the second knitting yarn is set lower than a dry heat shrinkage ratio of the one or more other knitting yarns composing the warp knitted tape.

2. The warp knitted tape for the slide fastener according to claim 1, wherein the dry heat shrinkage ratio of the one or more first knitting yarns is 4 to 10% while the dry heat shrinkage ratio of the one or more other knitting yarns is 10 to 20%.

3. The warp knitted tape for the slide fastener according to claim 1, wherein the dry heat shrinkage ratio of the one or more first knitting yarns is 4 to 10%.

4. The warp knitted tape for the slide fastener according to claim 1 or 2, wherein a width of a groove between one wale in the remaining group of the wales that is most adjacent to the fastener element attaching portion and another wale in the remaining group of the wales that is adjacent to the one wale is 0.8 to 1.5 mm.

5. The warp knitted tape for the slide fastener according to claim 1 or 3, wherein the one or more first knitting yarns and the second knitting yarn are composed of multiple filaments having a single fiber size of 1.5 to 4.0 dTex while the one or more other knitting yarns are composed of multiple filaments having a single fiber size of 0.5 to 1.5 dTex.

6. The warp knitted tape for the slide fastener according to claim 1, wherein the one or more other knitting yarns are bulky processed yarns.

* * * * *